United States Patent [19]

Ide

[11] Patent Number: 4,627,997

[45] Date of Patent: Dec. 9, 1986

[54] THERMAL TRANSFER RECORDING MEDIUM

[75] Inventor: Youji Ide, Mishima, Japan

[73] Assignee: Ricoh Co., Ltd., Tokyo, Japan

[21] Appl. No.: 747,160

[22] Filed: Jun. 20, 1985

[30] Foreign Application Priority Data

| | | | |
|---|---|---|---|
| Jun. 22, 1984 | [JP] | Japan | 59-128841 |
| Aug. 29, 1984 | [JP] | Japan | 59-179862 |
| Mar. 15, 1985 | [JP] | Japan | 60-52823 |
| Mar. 19, 1985 | [JP] | Japan | 60-55121 |
| Apr. 2, 1985 | [JP] | Japan | 60-70508 |

[51] Int. Cl.[4] ..... B41M 3/12

[52] U.S. Cl. ..... 428/216; 428/207; 428/336; 428/484; 428/488.1; 428/690; 428/913; 428/914

[58] Field of Search ..... 428/185, 207, 211, 488.1, 428/488.4, 690, 913, 914, 212, 215, 216, 332, 334–337, 339, 484

[56] References Cited

U.S. PATENT DOCUMENTS

| | | | |
|---|---|---|---|
| 2,822,288 | 2/1958 | Harvey et al. | 428/488.1 |
| 4,307,149 | 12/1981 | Scott et al. | 428/207 |
| 4,472,479 | 9/1984 | Hayes et al. | 428/488.4 |

*Primary Examiner*—Bruce H. Hess

*Attorney, Agent, or Firm*—Flynn, Thiel, Boutell & Tanis

[57] ABSTRACT

The present invention provides a fluorescent thermal transfer recording medium that comprises forming a thermally meltable inking layer consisting essentially of a fluorescent substance, a coloring agent, waxes and a binder on a heat resisting substrate.

16 Claims, 11 Drawing Figures

THERMAL TRANSFER RECORDING MEDIUM

BACKGROUND OF THE INVENTION (a) Field of the Invention

The present invention relates to a thermal transfer recording medium for carrying out print recording on a recording paper utilizing the thermal melting property of an inking layer.

(b) Description of the Prior Art

As a thermal transfer recording medium, there is known one which comprises providing a thermal melting inking layer containing coloring agents such as dyes and/or pigments, fixing agents such as waxes, and other additives on a heat resisting substrate, such as polyester film. The print recording method using the above mentioned recording medium is carried out by placing a recording paper on the surface of the thermal melting inking layer of the medium, putting a thermal head thereon from the recording medium side, and melting and transferring the corresponding portion of the inking layer onto said recording paper.

However, the thus obtained records are in danger of being forged when used for the special purposes such as checks, postage stamps and the like.

On the other hand, as a fluorescent thermal transfer recording medium, there is known one which comprises providing, on the same substrate, a thermal melting inking layer consisting of fluorescent pigments, waxes and hot-melt adhesives (see Japanese Laid Open Patent Application No. 54598/1984 Specification). In the case of this fluorescent thermal transfer recording medium, the image transfer characteristic is improved as the amount of the fluorescent pigment used is decreased, but the image density (color density) and fluorescent strength are insufficient. In case the fluorescent pigments are used in large amounts, the image density and fluorescent strength are surely increased, but a sufficient image density cannot be obtained and further, the image transfer characteristic deteriorates.

SUMMARY OF THE INVENTION

The object of the present invention is to provide a thermal transfer recording medium which is free from the possibility of being forged, and further, can attain sufficient image density, fluorescent intensity and image transfer characteristics.

This object can be achieved by further incorporating a fluorescent substance in the inking layer of the thermal transfer recording medium which comprises providing, on a heat resisting substance, a thermal melting inking layer consisting essentially of a coloring agent comprising dyes and/or pigments, waxes and fixing agents.

DETAILED DESCRIPTION OF THE INVENTION

First, a detailed description will generally be made of the fluorescent substances usable in the present invention.

The fluorescent substances include inorganic ones and organic ones. The organic ones are roughly divided into (A) fluorescent pigment type, (B) fluorescent dye type and (C) wax-like substance solid solution type of fluorescent dyes or resin solid solution type of fluorescent dyes (which will be called "fluorescent dye solid solution" in short hereinafter). As inorganic fluorescent substances there may be enumerated ZnS–Cu mixtures, ZnS–Cu+CdS–Cu mixtures, ZnO–Zn mixtures and the like. Reference will be made to organic type fluorescent substances. As type (A) fluorescent substances there are enumerated Lumogen L yellow, Lumogen L Brilliant Yellow, Lumogen L Red Orange, and the like. As type (B) fluorescent substances there are enumerated Thioflavine (CI 49005); Basic Yellow BG (CI 46040); Fluorescein (CI 45350); Rhodamine B (CI 45170); Rhodamine 6G (CI 45160); Eosine (CI 45380); conventional white fluorescent brightener such, for instance, as CI Fluorescent Brightening Agent 85, 166 and 174; those obtained by rendering the above mentioned fluorescent dyes oil soluble (and simultaneously water insoluble) with organic acids such, for instance, as Oil Pink #312 obtained by rendering Rhodamine B oil soluble and Barifast Red 1308 obtained by rendering Rhodamine 6G oil soluble (produced by Orient Chemical Co.); and those obtained by lake formation of the above fluorescent dyes with metal salts and other precipitants such as, Fast Rose and Fast Rose Conc obtained by lake formation of Rhodamine 6G (produced by Dainichi Seika Kogyo K.K.). In the wax-like substance solid solution type or resin solid solution type (C), as the fluorescent dyes there can be used those enumerated in the preceding (B), as the wax-like substances there are used higher fatty acid ethanolamines, higher fatty acid esters such as sorbitan higher fatty acid ester, glycerine higher fatty acid ester, acylated sorbitan, acylated mannitol, and the like, and as the resins there are used polycaprolactone, polyethylene glycol, aromatic sulfonamide resin, acrylic resin, polyamide resin, polyvinyl chloride, vinyl chloride-vinyl acetate copolymer, alkyd resin, urea resin, melamine resin, benzoguanamine resin, and copolycondensate or copolymer of above resin materials. These wax-like substances and resins can be dyed with fluorescent dyes since said substances and resins include polar groups having an affinity for fluorescent dyes (for instance, amide group, ester group, hydroxyl group, lactone bond, acrylic group, vinyl group and the like). Of the above enumerated fluorescent substances, the fluorescent dye solid solution type (C) is preferable in the present invention from the points of thermal sensitivity and accordingly thermal transferring property affecting the image distinction; color distinction, weather-proofing; fluorescent strength at the time when dispersed in a dispersion medium, and the like. Further, the wax-like substance solid solution or resin solid solution having a melting point (mp) or softening point (sp) of 50°–140° C. is preferably used in order to enhance the thermal transfering property. As examples of the wax-like substance solid solution or resin solid solution, there can be enumerated the following substances: (For reference, the melting points or softening points of these substances are included.) As the wax-like substances there are enumerated stearic acid monoethanolamide (mp 91°–95° C.), lauric acid monoethanolamide (mp 80°–84° C.), coconut oil fatty acid monoethanolamide (mp 67°–71° C.), sorbitan behenic acid ester (mp 68.5° C.), sorbitan stearic acid ester (mp 51° C.), glycerine monostearic acid ester (mp 63°–68° C.), acetyl sorbitol (mp 99.5° C.), benzoyl sorbitol (mp 129° C.), acetyl mannitol (mp 119°–120° C.) and the like. As the resins there are enumerated polycaprolactone having an average molecular weight of 10,000 (mp 60°–65° C.), polyethylene glycol having an average molecular weight of 6000 (mp 62° C.), low condensation polymerized melamine toluenesulfonamide resin (sp 105° C.), low condensation polymerized benzyltoluene sulfonamide resin (sp 68° C.), acrylic resin (sp 85° C.), linear polyamide resin (sp 60° C.) and the like.

Next, explanation will be made about the process of making (C) the solid solution of fluorescent dye, which is preferable as the fluorescent substance of the present invention. In this instance, the solid solution of wax-like substance or resin can be made by a method of massive resin grinding, emulsion polymerization, resin separating or the like. The massive resin grinding method (British Pat. No. 845462) comprises melting and mixing a wax-like substance or resin with a fluorescent dye, thereafter cooling and solidifying same, and grinding the resulting mass. The emulsion polymerization method (British Pat. No. 822709) comprises adding a resin powder resulting from emulsion polymerization to a hot aqueous fluorescent dye solution thus causing the dye to adhere to the resin powder, and then filtering and drying the coated powder. The resin separating method comprises adding an aqueous solution of water soluble metal salt, such as $Al_2(SO_4)_3.8H_2O$, to an aqueous solution of a water soluble salt of a resin and a fluorescent dye for reaction, if necessary adjusting the solution so that it is acidic and separating, as a metal salt, the resin dissolved therein with the fluorescent dye adhered thereon, and then filtering and drying the same. The suitable percentage of fluorescent dye contained in the thus obtained fluorescent dye solid solution is about 0.1–5.0 wt.%.

Next, preparation examples of fluorescent dye solid solutions according to the above mentioned methods are given.

Preparation examples according to the massive resin grinding method:

PREPARATION EXAMPLE 1

(1) Benzylsulfonamide resin . . . 360 parts
(2) Melamine resin (unmodified resin in B state) . . . 78.4 parts
(3) Rhodamine B Extra . . . 4.02 parts
(4) Rhodamine 6GDN Extra . . . 4.02 parts Component (1) was melted at 125° C. Component (2) was added thereto and dissolved. When the resin became transparent at 135° C., the temperature was raised to 170°–180° C. Components (3) and (4) were added thereto and dissolved. The mixture was cooled and solidified, and thereafter ground to obtain a blue-reddish fluorescence-emitting resin solid solution (sp 120° C.). This solid solution was observed to have a fluorescent maximum wavelength of 601 nm, and a relative fluorescent intensity of 162 when said solid solution was made a 10 μ-thick film on a polyester film. These properties were measured by means of a HITACHI 650-60 fluorescence spectrophotometer under the conditions: scanning speed 120 nm/min. and slit width (both on the exciting and light-emitting sides) 1 nm.

PREPARATION EXAMPLE 2

(1) Low condensation polymerized benzyltoluene sulfonamide resin: 97.5 parts
(2) Rhodamine B Extra: 1.0 part
(3) Rhodamine 6GDN Extra: 1.0 part
(4) Brilliant Sulfoflavin: 0.5 part By exactly the same procedure as Preparation Example 1, except that the resin component (1) was melted and made transparent at 100° C., there was obtained a red-orange fluorescence-emitting resin solid solution (sp 68° C.). This solid solution was observed to have a fluorescent maximum wavelength of 605 nm and a relative fluorescent intensity of 146 when said solid solution was made a 10 μ-thick film on a polyester film.

PREPARATION EXAMPLES 3 TO 7

Fluorescent dye solid solutions were prepared using the following wax-like substances or resins and fluorescent dyes according to the same procedure as set forth in Preparation Example 2.

PREPARATION EXAMPLE 3

Linear polyamide resin: 97.5 parts
Rhodamine B Extra: 1.0 part
Rhodamine 6GDN Extra: 1.0 part
Brilliant Sulfoflavin: 0.5 part

PRESCRIPTION OF PREPARATION EXAMPLE 4

Sorbitan behenic acid ester: 98.5 parts
Rhodamine B Extra: 0.6 part
Rhodamine 6GDN Extra: 0.6 part
Brilliant Sulfoflavin: 0.3 part

PRESCRIPTION OF PREPARATION EXAMPLE 5

Coconut oil fatty acid monoethanolamide: 99.5 parts
Brilliant Sulfoflavin: 0.5 part

PRESCRIPTION OF PREPARATION EXAMPLE 6

Sorbitan behenic acid ester: 96.5 parts
C.I. Fluorescent Brightening Agent 176: 3.5 parts

PRESCRIPTION OF PREPARATION EXAMPLE 7

Linear polyamide resin: 73.1 parts
Sorbitan behenic acid ester: 24.4 parts
Rhodamine B Extra: 1.0 part
Rhodamine 6GDN Extra: 1.0 part
Brilliant Sulfoflavin: 0.5 part The fluorescent maximum wavelength, fluorescent color and relative fluorescent intensity of each of the thus obtained solid solutions are as shown in Table 1.

TABLE 1

| | Fluorescent maximum wavelength (nm) | Fluorescent color | Relative fluorescent intensity | Melting or softening point (°C.) |
|---|---|---|---|---|
| Preparation Example 3 | 604 | Reddish orange | 106 | 60 |
| Preparation Example 4 | 605 | Reddish orange | 59.1 | 68.5 |
| Preparation Example 5 | 504 | green | 39.5 | 67–71 |
| Preparation Example 6 | 439 | Blue | 112 | 68.5 |
| Preparation Example 7 | 605 | Reddish orange | 98.4 | 61 |

Preparation example according to the emulsion polymerization method:

PREPARATION EXAMPLE 8

(1) 3,6-bis-diethylamino-9-(2'-carboxyphenyl)xanthenyl chloride: 1 part
(2) Diacetone alcohol 3 parts
(3) water 300 parts
(4) Phosphoric acid 0.1 part (5) Emulsion polymerized polyvinyl chloride powder: 100 parts Component (1) was dissolved in a mixed solution of Components (2), (3) and (4), and same was heated to 80°-100° C. Component (5) was added thereto, and same was maintained at 80°-100° C. while stirring to cause the dye to adhere to the solid component. This was rinsed and dried at 80°-120° C. to thereby obtain a red fluorescence-emitting resin solid solution (sp 165° C.). This solid solution was observed to have a fluorescent maximum wavelength of 571 nm and a relative fluorescent intensity of 96.

Preparation example according to resin separating method:

PREPARATION EXAMPLE 9

(1) Benzoic acid-modified pentaerythritol-phthalic anhydride alkyd (acid number 91) 27.5% 100 parts
(2) Ammonium hydroxide (28% $NH_3$) 25 parts
(3) Water 500 parts
(4) Rhodamine B base 1.8 parts
(5) Rhodamine 6G 1 part Component (1) was dissolved in a mixed solution of components (2) and (3) to prepare ammonium salt. Components (4) and (5) were dissolved in this ammonium salt solution. This solution was diluted with 2100 parts of water. 200 parts of a 10% aqueous solution of aluminum sulfate.octadecahydrate was dropped and reacted in this diluted solution while stirring. If the reaction mixture separated here is alkaline, it must be made slightly acidic by adding a dilute acid such as, 10% acetic acid. Then, the reaction mixture was heated at 50° C. for 1 hour while stirring, filtered, thereafter vacuum-dried, and pulverized to obtain a blue-reddish fluorescence-emitting resin (aluminium salt) solid solution (sp 210° C.). This solid solution was observed to have a fluorescent maximum wavelength of 602 nm and a relative fluorescent intensity of 121. The fluorescent substances comprising the above mentioned solid solutions are available, as the products by Sinloihi K.K. marketed under the designations FZ-3041 (sp 120°-130° C.) (benzyl sulfonamide resin); FZ-2000 (sp 110° C.), FZ-3000 (sp 120°-130° C.), BO-100 (sp 90°-100° C.) and FM-11 sp (110°-125° C.) (melamine.toluene sulfonamide resin type); SM-13 (sp 71° C.) and SB-10 (sp 90° C.) (acrylic resin type); FA-41 (sp 190° C.) (melamine resin type); and the like.

Next, the amounts of fluorescent substances used will be explained. Each fluorescent substance generally emits its fluorescence when the solution it is contained in is dilute. The fluorescent intensity also increases as the concentration increases, but when the concentration exceeds a certain point, concentration quenching takes place to decrease the fluorescent intensity. This fluorescent intensity is also affected by the coloring degree or color concentration of the solution. Accordingly, the concentration or amount of the fluorescent substance used in the thermal melting inking layer is mainly determined so that the fluorescent intensity inherent in the fluorescent substance itself and the coloring degree or color concentration caused by the coloring agent used might be balanced. In addition thereto, the thermal transferring characteristic of the inking layer should be taken into consideration. In practice, when the fluorescent substance is a fluorescent pigment or fluorescent dye the amount of said substance used is 5-40%, preferably 10-25%, of the weight of the inking layer, while when the fluorescent substance is a fluorescent dye solid solution the amount of said substance used is 20-70%, preferably 30-60%, of the weight of the inking layer. It is preferable in the present invention that the fluorescent substance should be located adjacent to the substrate in order to enhance the fluorescent intensity by using the fluorescent substance in said given amount. The reason is as follows. When the fluorescent substance and the coloring agent are used as an admixture, if the coloring agent has an absorption band which absorbed the fluorescence, the fluorescent intensity of this admixture (solid solution state) is relatively low. This seems to be caused by the filtering effect and fluorescent reabsorption of the coloring agent. Therefore, it may be said that the fluorescent intensity of a printed image is determined by how much of the fluorescent substance exists near the surface of the printed image.

Next, the other materials used in the thermal melting inking layer will be explained.

First, as the dye or pigment for use in the coloring agent there may be employed ones which have usually been used in this field. As dyes, there may be enumerated oil soluble dyes such as, Sumikaron Violet RS, Dianix Fast Violet 3R-FS, Kanaron Polyole Brilliant Blue-N-BGM (anthraquinone type dyes); Kayaron Polyole Brilliant Blue-BM, Kayaron Polyole Dark Blue-2BM, Sumikaron Diazoblack 5G, (azotype dyes); Direct Dark Green B, Direct Brown M, Direct Fast Black D (direct dyes); Kayanol Milling Cyanine 5R (acidic dye); Sumikalyl Blue-6G, Aizen Malachite Green, Rhodamine B, Rhodamine 6G, Victoria Blue (basic dyes); and the like. As pigments, on the other hand, there may be enumerated Victoria Blue lakes, metal-free phthalocyanine, phthalocyanine, Fast Sky Blue, Permanent Red 4R, Brilliant Fast Scarlet, Brilliant Carmine BS, Permanent Carmine FB, Lithole Red, Permanent Red F5R, Brilliant Carmine 6B, Pigment Scarlet 3B, Rhodamine Lake B, Rhodamine Lake T, Alizarin Lake, Fast Red, Bright Red G Toner, Lyonol Red CP-A, Chrome Yellow, Zinc Yellow zinc chromate, Lemon yellow (barium chromate), Cadmium yellow, Naphthol Yellow B, Hansa Yellow 5G, Hansa Yellow 3G, Hansa Yellow G, Hansa Yellow A, Hansa Yellow RN, Hansa Yellow R, Benzidine Yellow, Benzidine Yellow G, Benzidine Yellow GR, Permanent Yellow NCG, Quinoline Yellow Lake, Fast Yellow and the like. It is preferable in the present invention to select a coloring agent which does not absorb the fluorescence of the fluorescent substance or does not absorb it much, in practice, the one whose fluorescence absorption is 40% or less, with the intention of avoiding the decrease in fluorescent intensity of the fluorescent substance caused by the coloring agent. This decrease in fluorescent intensity of the fluorescent substance caused by the coloring agent may be explained with reference to the drawing as shown in FIG. 1. This relationship may be considered as follows. That is, the fluorescence spectrum 2a of the fluorescent substance in the inking layer overlaps the absorption spectrum 1a at D, whereby the coloring agent absorbs the light (fluorescence) emitting from the fluorescent substance and thus the fluorescent intensity deteriorates. This problem may be solved by selecting the appropriate color (absorption spectrum) of the coloring agent relative to the fluorescent color (fluorescence spectrum) of the fluorescent substance used.

Concrete examples of the suitable combinations of fluorescent substances with coloring agents (of the same color types) will be given below:

| Fluorescence color of fluorescent substance | Color tone of coloring agent |
|---|---|
| Red series: | Red series: |
| Lumogen L Red Orange, Resin solid solution of Rhodamine B, Resin solid solution of Rhodamine 6G, Resin solid solution of Rhodamine B Extra, Resin solid solution of Rhodamine 6GDN Extra, Rhodamine B Extra - Rhodamine 6GDN mixture, Resin solid solution of Rhodamine B Extra - Rhodamine 6GDN mixture, and the like. | Rhodamine B, Phodamine 6G, Permanent Red 4R, Brilliant Fast Scarlet, Brilliant Carmine BS, Lithol Red, Permanent Red F5R, Brilliant Carmine 6B, Rhodamine Lake B, Rhodamine Lake T, Fast Red, Bright Red G toner, Lyonol Red CP-A, Lake Red C, and the like. |
| Yellow series: | Yellow series: |
| Lumogen L Yellow, Lumogen L Brilliant Yellow, Resin solid solution of Basic Yellow HG, Resin solid solution of fluoresceine, and the like. | Chrom Yellow, Zinc Yellow-zinc chromate, Lemon Yellow, Cadmium Yellow, Naphthol Yellow B, Hansa Yellow 5G, Hansa Yellow 3G, Hansa Yellow G, Hansa Yellow A, Hansa Yellow RN, Hansa Yellow R, Benzidine Yellow G, Benzidine Yellow GR, Permanent Yellow OG, Quinoline Yellow Lake, Fast Yellow, and the like. |
| Blue series: | Blue series |
| CI Fluorescent Brightening Agent 85, CI Fluorescent Brightening Agent 66, CI Fluorescent Brightening Agent 174, and the like. | Kayanol Milling Cyanine 5R, Sumikalyl Blue 6G, Victoria Blue, Victoria Blue Lake, Metal-free phthalocyanine, Phthalocyanine copper, Fast Sky Blue, and the like. |

As described above, the resin solid solution of the fluorescent dye is preferable as the fluorescent substance itself, and the pigment is preferable as the coloring agent itself. When intending to obtain a red color type thermal transfer recording medium, it is preferable to use a resin solid solution of rhodamine type fluorescent dye in combination with an azo lake pigment such as Brilliant Carmine BS, Brilliant Carmine 6B, Bright Red G toner, Lake Red C, or the like, as the coloring agent.

Of the coloring agents, a pigment is preferable in the points of light resistance, color transferability, melt resistance and the like. In any case, the suitable amount of the coloring agent used is about 1–30%, preferably 3–15%, of the weight of the inking layer in view of color density, printing quality and the like of transfer recordings.

Next, explanation will be made on waxes. Waxes are used as the agent for fixing the coloring agent, fluorescent substance and the like on the substrate. These waxes include waxes or resins which are easy to melt thermally, such as, carnauba wax, hydrogenation hardened castor oil, ouricury wax, microcrystalline wax, parafin wax, ceresin wax, montan wax, candelilla wax, shellac wax, insect wax, palm wax, beewax, low molecular weight polyethylene, polyvinyl stearate, and the like. The amounts of waxes used suitably are 30–90%, preferably 60–85%, of the weight of the inking layer.

Next, as the binders, there can be enumerated resins, which thermally soften or melt, such as polyvinyl chloride, polyvinyl acetate, polyvinyl fluoride, polyvinylbutyral, polyvinylidene chloride, polyvinyl alcohol, vinyl chloride-vinyl acetate copolymer, vinyl chloride-vinylidene chloride copolymer, polystyrene, polyethylene, ethylene-vinyl acetate copolymer, styrene-butadiene copolymer, acrylonitrile-styrene-butadiene copolymer, cellulose esters, cellulose ethers, petroleum resin and the like. The suitable amounts of binders used are 1–20, preferably 3–15%, of the weight of the inking layer.

The thermal melting inking layer may be further mixed with additives such as a softening agent and the like. As the softening agents, there may be enumerated liquid paraffin, lecithin, mineral oil, animal oil, vegetable oil, (for instance rape seed oil), and the like. The suitable amounts of softening agents used are 2% or less.

As the heat resisting substrate, there may be used polyester film, polypropylene film, polyimide film, polycarbonate film, glassine paper, condenser paper and the like. The suitable thickness of said substrate is about 3–20$\mu$.

The thermal transfer recording medium according to the present invention may be generally prepared by the steps of thermally melting a composition comprising a coloring agent, a fluorescent substance, waxes, a binder and an additive, if needed, and applying this hot melt on a heat resisting substrate; or by the steps of dissolving or dispersing said composition in a suitable solvent; and applying and drying this solution or dispersion on a heat resisting substrate. In order to obtain a more intensive fluorescence, in this instance, it is preferable to divide the wax and the additive into two suitable amounts respectively; mixing the one with the pigment and/or dye and the other with the fluorescent substance respectively to thereby form a coloring ink system and a fluorescent ink system; thermally melting each system as stated above or dissolving or dispersing each system in the solvent, thereafter mixing these systems, applying this mixture on the substrate as stated above.

The thermal transfer recording medium obtained by this general method, as shown in FIG. 2, is structured so as to provide, on a heat resisting substrate 10, a thermally meltable inking layer 11 which comprises uniformly dispersing a fluorescent substance 2 and a coloring agent 3 in a wax fixing agent and resin binder 4. In this connection, the numeral 1 is the thermal transfer recording medium.

On the other hand, the methods for preparing the thermal transfer recording medium wherein the fluorescent substance exists adjacent to the substrate include (1) separately preparing the fluorescent ink system containing the fluorescent substance and the coloring ink system containing the coloring agent as described above, and applying the fluorescent ink system and the coloring ink system, in order, on the heat resisting substrate to thereby form a two-layer thermally meltable ink layer comprising a fluorescent ink layer and a coloring ink layer; and (2) applying the thermally meltable ink containing the fluorescent substance and the coloring agent on the heat resisting substrate so that the fluorescent substance is located more closely to the substrate side and the coloring agent exists more closely to the surface of the inking layer making use of the difference in specific gravity between the fluorescent substance and the coloring agent to thereby form a monolayer type inking layer; and the like. Method (1) is profitable.

In method (1), it is necessary to rapidly carry out the ink coating operation (and the drying operation if necessary) so that both inking layers may not admix due to thermal diffusion when the coating film is formed, and there is a possibility that the fluorescent ink is not transferred completely depending on the print recording conditions and unevenness of fluorescence is caused on printings. In this instance, good results may be obtained by using, in each ink, waxes superior in transferability such as carnauba wax, hydrogenation hardened castor oil, candelilla wax, and the like, or by somewhat delaying the time of separating a thermal head after printing is completed.

The thermal transfer recording media obtained by the above mentioned modified methods (1) and (2) are constructed as shown in FIGS. 3 and 4. In the drawing, reference numeral 13 denotes a fluorescent inking layer and 14 denotes a coloring inking layer.

In each thermal transfer recording medium, the suitable thickness of the thermally meltable inking layer is 2–10 μm, preferably 3–7 μm. In the laminated layer-type thermal transfer recording medium comprising the fluorescent inking layer and the coloring inking layer, the suitable thickness of each layer is 1–5 μm.

The printing record using the thermal transfer recording media of the present invention may be carried out in the usual manner by placing a transfer paper on the surface of the inking layer of the recording medium, positioning a thermal head on the recording medium side, and transferring the portion of the inking layer corresponding to said head onto the transfer paper. In the case of the recording medium shown in FIG. 3, recordings can be obtained by the method illustrated in FIG. 5. Component 5 is a thermal head, 6 a transfer paper, and 12 a printed image. In this instance, the fluorescent substance 2 in the image 12 is located on the surface of the image, and therefore the fluorescent intensity (or intensity) and the color density are emphasized.

As is evident from the above explanation, the thermal transfer recording media of the present invention are advantageous in that since said recording media contains the fluorescent substance in its thermally meltable inking layer, the recordings obtained by print recording have a fluorescent distinguishability, and accordingly the recordings can be reliably used for the specific purposes of checks, postage stamps and the like without any concern of forging.

In case the fluorescent dye solid solution is used as the fluorescent substance, there may be formed a transfer image which is of high color density, high image quality and emits a high intensity fluorescence, because said solid solution is superior in heat sensitivity and accordingly thermal transferability. When the solid solution has a melting or softening point of 50°–140° C., these aspects of the invention can be further enhanced.

When the fluorescent substance contained in the thermally meltable inking layer is located adjacent to the substrate, the color density and fluorescent color intensity of printed transfer images can be increased, and simultaneously the printing quality thereof can be improved.

Further, when the coloring agent is used which is unable to absorb the fluorescence of the fluorescent substance in large amounts, a high intensity fluorescence can be emitted without lowering the color density of recordings.

IDENTIFICATION OF REFERENCE NUMBERS

- 1*a* . . . absorption spectrum of coloring agent or thermally meltable inking layer,
- 2*a* . . . fluorescence spectrum of fluorescent substance or thermally meltable inking layer,
- D . . . overlap portion between 1*a* and 2*a* (amount of fluorescence of fluorescent substance absorbed by coloring agent),
- 1 . . . thermal transfer recording medium of this invention,
- 2 . . . fluorescent substance,
- 3 . . . coloring agent,
- 4 . . . waxes and binder,
- 5 . . . thermal head,
- 6 . . . transfer paper,
- 10, 10′ . . . heat resisting substrate (or 10 . . . substrate side, 10′ . . . transfer paper side),
- 11 . . . thermally meltable inking layer,
- 12 . . . printed image,
- 13 . . . fluorescent inking layer,
- 14 . . . coloring inking layer,
- 3*a* . . . fluorescence spectrum on substrate 10 side,
- 3*b* . . . fluorescence spectrum on transfer paper 10′ side,
- A . . . exciting maximum wavelength,
- B . . . fluorescent maximum wavelength,
- C . . . difference in fluorescent intensity between substrate 10 side and transfer paper 10′ side.

DESCRIPTION OF THE PREFERRED EMBODIMENTS

The present invention will be explained with reference to examples as follows. Parts and ratios are all by weight.

EXAMPLES 1 TO 3

A coloring ink system and a fluorescent ink system having the following compositions were prepared.

| Components | Example 1 (part) | Example 2 (part) | Example 3 (part) |
|---|---|---|---|
| Coloring ink system | | | |
| Bright Red G toner (produced by TOYO INK Co.) | 3.13 | 3.13 | 3.13 |
| Lyonol Red CP-A (produced by TOYO INK CO.) | 3.13 | 3.13 | 3.13 |
| Seika Fast Yellow 2200M (produced by DAINICHI SEIKA KOGYO CO.) | 1.24 | 1.24 | 1.24 |
| Carnauba wax | 17.50 | 15.95 | 13.9 |
| Paraffin wax (melting point: about 63° C.) | 17.50 | 15.95 | 13.9 |
| Poly caprolactone (number average molecular weight: 10000) | 7.50 | 6.85 | 5.95 |
| Fluorescent ink system | | | |
| Benzyl sulfonamide resin solid solution* of Rhodamine B Extra Rhodamine 6GDN (1:1 ratio) mixture | 7.5 | 15.0 | 25.0 |
| Carnauba wax | 17.5 | 15.95 | 13.9 |
| Paraffin wax (melting point: about 63° C.) | 17.5 | 15.95 | 13.9 |
| Poly caprolactone (molecular weight: 10000) | 7.5 | 6.85 | 5.95 |

*FZ-3041 Red Orange Color produced by Sinloihi K.K.; amount of fluorescent dye: 1.8% of the total; fluorescence: red orange; preparation method: massive resin grinding method.

Next, the coloring ink system and the fluorescent ink system were each melted and each component was uniformly dispersed therein and then were admixed. This mixture was hot-melt coated on a 6μ-thick polyester film to thereby form an about 5μ-thick thermally meltable inking layer.

Figure 1:
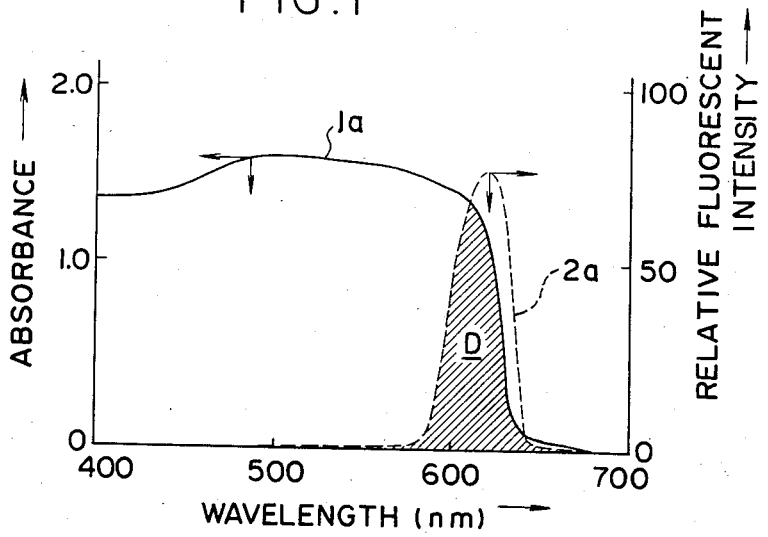
FIG. 1 is a graph illustrating the relationship between the fluorescence spectrum and the absorption spectrum of the thermally meltable inking layer in one example of the thermal transfer recording media.
Figure 2:
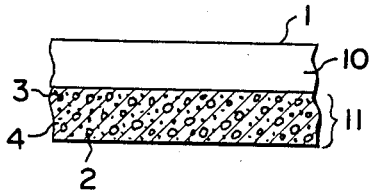
FIG. 2 is an enlarged cross-sectional view of the fundamental thermal transfer recording medium of the present invention.
Figure 3:
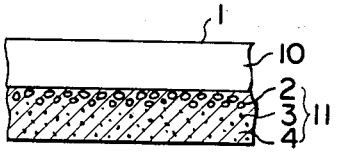
FIGS. 3 to 4 are each an enlarged cross-sectional view of the modified thermal transfer recording media of the present invention.
Figure 4:
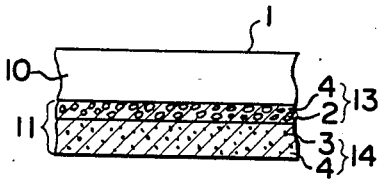
Figure 5:
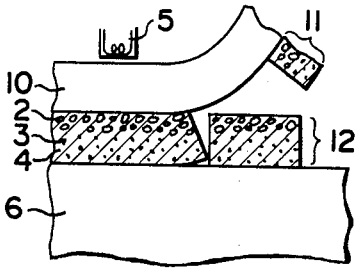
FIG. 5 is a view explaining the print recording method using the recording media of FIG. 3.
Figure 6:
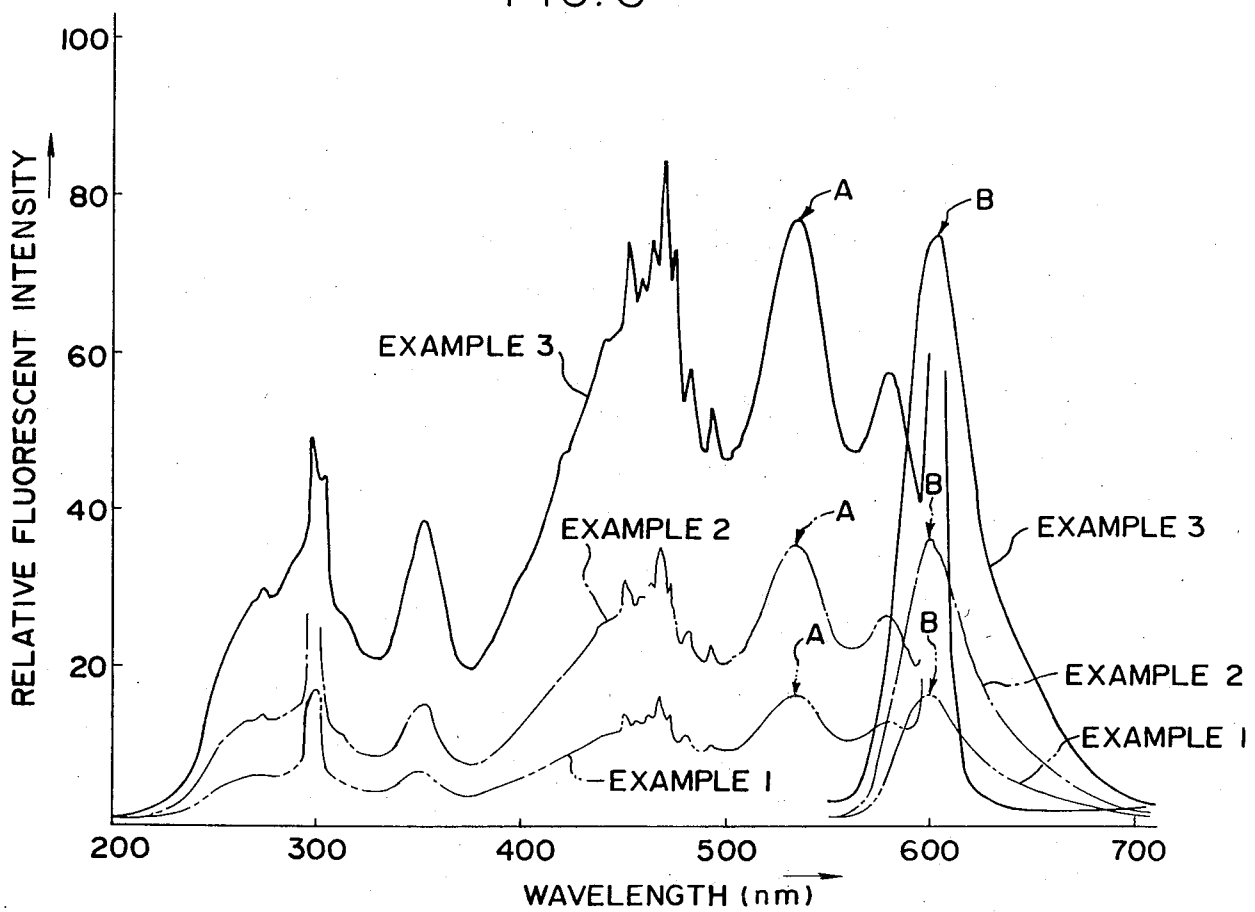
FIG. 6 is a graph illustrating the fluorescence spectrum of the thermally meltable inking layer for each of the thermal transfer recording media prepared in Examples 1 to 3.

The fluorescence spectrum (reflectance) of the inking layer of the thus obtained thermal transfer recording medium is shown in FIG. 6. The measuring conditions were as shown below.

measuring apparatus: HITACHI 650-60 Fluorescence Spectrophotometer (scanning speed: 120 nm/min., slit: 1 nm on both exciting and fluorescent sides)

Further, the exciting maximum wavelength A, fluorescent maximum wavelength B and relative fluorescent intensity corresponding to this figure are shown in Table-2.

TABLE 2

| | Exciting maximum wavelength (nm) | Fluorescent maximum wavelength (nm) | Relative fluorescent intensity |
|---|---|---|---|
| Example 1 | 534 | 601 | 6.86 |
| Example 2 | 534 | 601 | 14.9 |
| Example 3 | 534 | 601 | 29.1 |
| Reference Example*1 | 530 | 554 | 29.0*2 |

*1 $2,618 \times 10^{-6}$ mol/l ethanol solution of Rhodamine 6G
*2 10 mm of quartz cell Next, a commercially available recording paper [PPC paper Type 1000 (PPC Copying Transfer Paper) produced by RICOH K.K.] was placed on the inking layer of each of these thermal transfer recording mediums. A thermal head was put thereon from the recording medium side under the conditions: heat energy applied on the thermal head 0.50 mJ/dot (at 8 dots/mm head) and pushing pressure about 500 g/cm$^2$, and the portion of the inking layer corresponding to the thermal head was melted and transferred onto the transfer paper. Thereafter, the recording medium was directly peeled off at an acute angle relative to the surface of the recording paper to thereby effect printing record. The obtained results are shown in Table-3.

TABLE 3

| | Color density* | Transferability | Printing sharpness |
|---|---|---|---|
| Example 1 | 0.86 | good | good |
| Example 2 | 1.01 | good | good |
| Example 3 | 1.00 | good or somewhat inferior | good |

*measured by the RD-514 Densitometer (using a green filter) produced by Macbeth Co.

As is evident from Table-2 and Table-3, the fluorescent strength (intensity) increases as the amount of the fluorescent substance in the thermally meltable inking layer increases. However, the color density of the transferred image does not change so much.

EXAMPLES 4 TO 7

A coloring ink system and a fluorescent ink system having the following compositions were prepared.

COLORING INK SYSTEM

Lyonol Red CP-A (produced by TOYO INK Co.): 5.60 parts
Seika Fast Yellow 2200M: 2.80 parts (produced by Dainichi Seika Kogyo Co.)
Carnauba wax: 19.16 parts
Paraffin wax (melting point about 63° C.): 19.16 parts
Petroleum resin: 8.16 parts
Mineral oil: 1.12 parts

FLUORESCENT INK SYSTEM

Same fluorescent substance as Example 1: 14.00 parts
Carnauba wax: 5.63 parts
Paraffin wax (melting point about 63° C.): 5.63 parts
Petroleum resin: 2.42 parts
Mineral oil: 0.32 part Next, the coloring ink system and the fluorescent ink system were each melted and each component was uniformly dispersed. Then, these systems as-melted were admixed in the percentages (20 parts of the coloring ink system and 10 parts of the fluorescent ink system). This mixture was hot-melt-coated on a 6μ-thick polyester film so as to have the same coated thickness as mentioned in Table-3 to thereby form a thermally meltable ink layer.

The thus obtained thermal transfer recording medium was measured to find the fluorescence spectrum and fluorescent intensity according to the same manner as Example 1. Further, printing record was carried out under the exactly same printing conditions as Example 1 except that the applied thermal energy was changed into 0.60 mJ/dot (at 8 dots/mm). The obtained results are shown in Table-4 and Table-5.

TABLE 4

| | Coated thickness (μ) | Exciting maximum wavelength (nm) | Fluorescent maximum wavelength (nm) | Relative Fluorescent intensity |
|---|---|---|---|---|
| Example 4 | 3.1 | 534 | 602 | 14.7 |

TABLE 4-continued

| | Coated thickness (μ) | Exciting maximum wavelength (nm) | Fluorescent maximum wavelength (nm) | Relative Fluorescent intensity |
|---|---|---|---|---|
| Example 5 | 3.8 | 534 | 602 | 15.2 |
| Example 6 | 4.9 | 534 | 602 | 15.2 |
| Example 7 | 5.7 | 534 | 602 | 14.9 |

TABLE 5

| | Color density | Transferability | Printing sharpness |
|---|---|---|---|
| Example 4 | 1.17 | somewhat inferior | somewhat inferior* |
| Example 5 | 1.25 | good | good or somewhat inferior |
| Example 6 | 1.28 | good | good |
| Example 7 | 1.32 | good | good |

*image is somewhat coarse.

Recordings obtained from the thermal transfer recording medium of Example 7 were high in color density and the fluorescence (red orange light) was fully discernible when exposed to radiation of a black light.

EXAMPLES 8 TO 10

A composition comprising the following components was prepared.

| (Components) | Example 8 (part) | Example 9 (part) | Example 10 (part) |
|---|---|---|---|
| Bright Red G Toner (produced by TOYO INK Co.) | 3.13 | 3.13 | 3.13 |
| Lyonol Red CP-A (produced by TOYO INK Co.) | 3.13 | 3.13 | 3.13 |
| Seika Fast Yellow-2200M (produced by DAINICHI SEIKA KOGYO K.K.) | 1.24 | 1.24 | 1.24 |
| Carnauba wax | 12.4 | 10.4 | 7.4 |
| Paraffin wax (mp about 68.5° C.) | 49.6 | 41.6 | 29.6 |
| Lecithin (softening agent) | 0.5 | 0.5 | 0.5 |
| Ethylene-vinyl acetate copolymer | 5.0 | 5.0 | 5.0 |
| Fluorescent dye solid solution of Preparation Example 7 (fluorescent substance) | 25.0 | 35.0 | 50.0 |

First, all the components, exclusive of the fluorescent substance, were thermally melted and uniformly dispersed. Then, the previously thermally melted fluorescent substance was added thereto to prepare a thermally meltable ink. Next, this ink was hot-melt-coated on a 6μ-thick polyester film to form an about 6μ-thick thermally meltable inking layer. Thus, a thermal transfer recording medium was prepared.

EXAMPLE 11

A thermal transfer recording medium was prepared according to exactly the same procedure as Example 9 except that a melamine resin solid solution of mixed Rhodamine B Extra—Rhodamine 6GDN (1:1) (Red Orange Color FA-41 produced by Sinloihi K.K. softening point 190° C.), made by means of the massive resin grinding method, was used as the fluorescent substance.

EXAMPLE 12

A thermal transfer recording medium was prepared according to exactly the same procedure as Example 10 except that the melamine resin solid solution disclosed in Example 12 was used as the fluorescent substance.

Next, a commercially available transfer paper for use in PPC (common paper copying machine) was placed on the surface of the inking layer of each of the above mentioned recording media. A thermal head was positioned theron from the recording medium side under the conditions: energy applied on the thermal head 0.80 mJ/dot (at 8 dots/mm head) and pushing pressure about 500 g/cm$^2$, and the portion of the inking layer corresponding to the thermal head was melted and transferred onto the transfer paper. Thereafter, the recording medium was directly peeled off at an acute angle relative to the transfer paper to thereby effect fluorescent printing record. Further, the thus obtained transfer images were subjected to fluorescene spectrum measurement. The obtained results are as shown in Table-6.

TABLE 6

| | | Example 8 | Example 9 | Example 10 | Example 11 | Example 12 |
|---|---|---|---|---|---|---|
| Printing quality | Color density*1 | 1.52 | 1.56 | 1.67 | 1.61 | 1.73 |
| | Transferability | good | good | good | somewhat inferior | inferior |
| | Sharpness | good | good | good | somewhat inferior | somewhat inferior |
| | Blur, non-uniformity | none | none | none | observed | observed |
| | Greasing | none | none | none | none | observed |
| Fluorescent spectrum data | Fluorescent maximum wavelength (nm) | 606 | 606 | 606 | 603 | 603 |
| | Relative fluorescent intensity*2 | 27.9 (420 nm) | 34.3 (420 nm) | 47.8 (420 nm) | 32.1 (468 nm) | 48.2 (468 nm) |

(Note)
*1Values measured by the Macbeth densitometer (using a green filter)
*2Bracketed values denote exciting wavelengths As is clear from this table, the recording media according to Examples 8 to 10 can emit a high density, high image quality and high intensity fluorescence as compared with the recording media according to Examples 11 and 12.

EXAMPLES 13 to 14

Both inks comprising the following compositions were each melted and dispersed into a uniform dispersing element.

Fluorescent ink (reddish orange fluorescence):

FZ-3041 Red Orange Color: 22.5 parts

Carnauba wax: 43.1 parts
Candelilla wax: 28.8 parts
Petroleum resin: 4.7 parts
Liquid paraffin: 0.9 part
Coloring ink (red):
Lyonol Red CP-A (produced by TOYO INK Co.): 10 parts
Seika Fast Yellow 2200M (produced by DAINICHI SEIKA KOGYO Co.): 5 parts
Carnauba wax: 39.5 parts
Paraffin wax (melting point about 68.5° C.): 39.5 parts
Petroleum resin: 5 parts
Liquid paraffin: 1 part Next, the fluorescent ink was melted and applied on a 6 μ-thick polyester film so as to have the coated film thickness shown in the following Table-7, and a fluorescent inking layer was formed. Thereafter, the coloring ink was melted and applied thereon so as to have the coated film thickness shown in Table-7, and a coloring inking layer was formed. Thus, a two-layer type thermal transfer recording medium was prepared.

TABLE 7

| | Example 13 | Example 14 |
|---|---|---|
| Thickness of fluorescent inking layer (μ) | 3.0 (13.5%)*1 | 3.0 (11.25%)*1 |
| Thickness of coloring inking layer (μ) | 2.0 (6.0%)*2 | 3.0 (7.5%)*2 |

*1Ratio of the fluorescent substance to the total weight of the fluorescent inking layer and the coloring inking layer.
*2Ratio of the coloring agent to the total weight of the fluorescent inking layer and the coloring inking layer.

EXAMPLE 15

Both inks prepared in Example 13 were mixed in the weight ratio of fluorescent ink/Coloring ink of 3/2 to thereby make a mixed ink containing the fluorescent substance and the coloring agent in the same concentrations as in Example 13 (fluorescent substance: 13.5%, coloring agent: 6.0%). This ink was melted and applied on a 6 μ-thick polyester film so as to have the coated film thickness of 5.0μ. Thus, there was prepared a thermal transfer recording medium of one thermally meltable inking layer type.

EXAMPLE 16

A thermal transfer recording medium of one thermally meltable inking layer type was prepared according to exactly the same procedure as Example 15 except that a mixed ink having the following composition (the fluorescent substance comprised 25% and the coloring agent was 6% of the total weight of the fluorescent inking layer and the coloring inking layer) was employed as the mixed ink.

Mixed ink:
FZ3041 Red Orange Color: 25 parts
Lyonol Red CP-A: 4 parts
Seika Fast Yellow 2200M: 2 parts
Carnauba wax: 35.1 parts
Candelilla wax: 14.6 parts
Paraffin wax (melting point about 68.5° C.): 13.3 parts
Petroleum resin: 5 parts
Liquid paraffin: 1 part A commercially available transfer paper for use in PPC was placed on the surface of the inking layer of the aforesaid recording medium. A thermal head was put thereon from the recording medium side under the conditions: heat energy applied on the thermal head 0.50 mJ/dot (at 8 dots/mm head) and pushing pressure about 500 g/cm$^2$, and the portion of each inking layer corresponding to the thermal head was melted and transferred onto the transfer paper. Thereafter, the recording medium was directly peeled off at an acute angle relative to the surface of the transfer paper to thereby effect printing record. The obtained results were shown in Table-6.

In addition, the above recording media and printings were subjected to fluorescence spectrum measurement. The obtained results were shown in Table-8.

Figure 7:
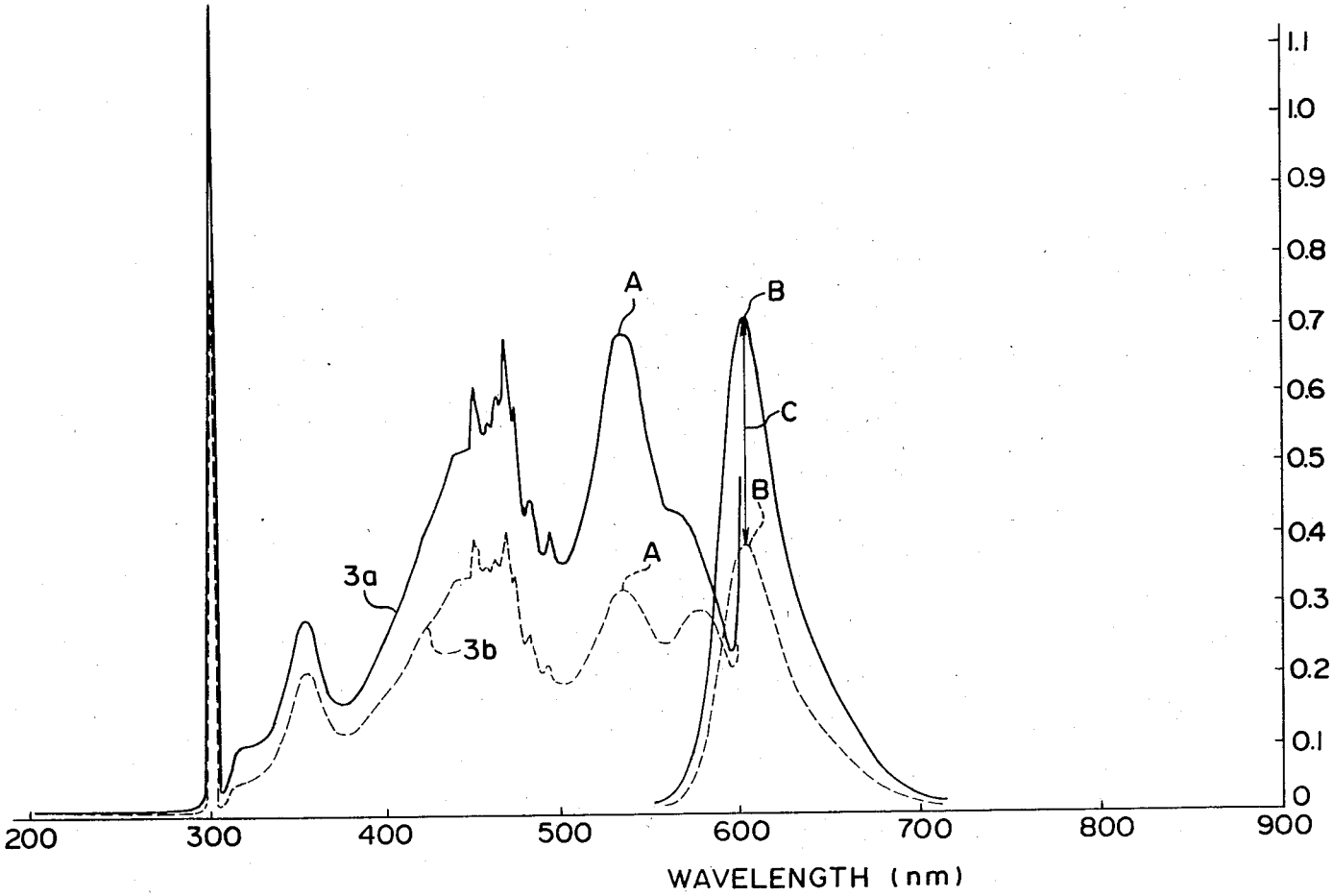
FIG. 7 is a graph illustrating the fluorescence spectrum of the thermal transfer recording medium prepared in Example 13.

The fluorescence spectrum of the recording medium according to Example 13 was also shown in FIG. 7. In FIG. 7, 3*a* denotes the substrate 10 side in FIG. 8, 3*b* denotes the transfer paper 10' side in FIG. 8, B denotes the fluorescent maximum wavelength, and C denotes the difference in fluorescent intensity between the substrate side and the transfer paper side.

TABLE 8

| | | | Example 13 | Example 14 | Example 15 | Example 16 |
|---|---|---|---|---|---|---|
| Fluorescence*2 spectrum data | Printings | Fluorescent maximum wavelength | 602 nm | 602 nm | 602 nm | 602 nm |
| | | Fluorescent intensity (exciting wavelength) | 28.3 (533 nm) | 24.6 (533 nm) | 14.9 (533 nm) | 28.1 (533 nm) |
| | Sandwich*1 structure | Fluorescent maximum wavelength | 602 nm | 602 nm | 602 nm | 602 nm |
| | | Fluorescent intensity on substrate side (exciting wavelength) | 28.6 (533 nm) | 26.3 (533 nm) | — | — |
| | | Fluorescent density on transfer paper side (exciting wavelength) | 13.1 (533 nm) | 13.8 (533 nm) | — | — |
| Printing quality | Color density*3 | | 1.47 | 1.59 | 1.45 | 1.61 |
| | Transferability | | good | good | good | bad |
| | Sharpness | | good | good | good | somewhat inferior |
| | greasing | | none | none | none | none |
| | Fine line blur | | none | none | none | observed |

Figure 8:
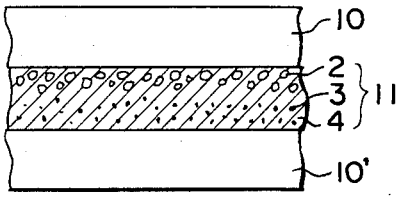
FIG. 8 is an explanatory view for measuring the fluorescence spectrum of the thermally meltable inking layer of the thermal transfer recording media prepared in each of Examples 13 to 20.

*1Values obtained by measuring sandwich-structured recording media from side 10 (which is called substrate side) or side 10' (which is called transfer paper side), said sandwich-structured recording medium as shown in FIG. 8 comprising thermally adhering the same substrate as this recording medium (6 μ-thick polyester film) on the inking layer side of the recording medium.
*2Measured by the HITACHI 650-60 Fluorescence Spectrophotometer (scanning speed: 120 nm/min, Slit width: 1 nm on both exciting and luminescent sides).
*3Values measured by the RD-914 Green Filter produced by Macbeth Co.

It is clear from this table that although the same-concentrated fluorescent substance has been employed, the recording media of Examples 13 and 14 emit a high-intensity fluorescence as compared with those comparative recording media. In order to obtain the same intensive fluorescence as Example 13 by means of these comparative recording media, it is necessary that the fluorescent substance should be contained in the inking layer in the percentage of about 25%, as seen in Example 16, and consequently blur will take place especially in the printed fine line area.

EXAMPLES 17 to 18

Both fluorescent and blue inks comprising the undermentioned compositions were each melted and dispersed into a uniform dispersing element.

Fluorescent ink (reddish orange fluorescence):
Fluorescent dye solid solution prepared in Preparation Example 7: 50.0 parts
Candelilla wax: 49.0 parts
Liquid paraffin: 1.0 part
Coloring ink (red):
Lyonol Red CP-A (produced by TOYO INK Co.): 10.0 parts
Seika Fast Yellow 2200M (produced by DAINICH SEIKA KOGYO K.K.): 5.0 parts
Carnauba wax: 15.8 parts
Paraffin wax (melting point about 68.5° C.): 5.0 parts
Petroleum resin: 5.0 parts
Liquid paraffin: 1.0 part Next, the fluorescent ink was melted and applied on a 6 μ-thick polyester film so at to have the coated film thickness as shown in the following Table-9, and a fluorescent inking layer was formed. Thereafter, the coloring ink was melted and applied thereon so as to have the coated film thickness shown in Table-9, and a coloring inking layer was formed. Thus, a thermal transfer recording medium was prepared.

TABLE 9

| | Example 17 | Example 18 |
|---|---|---|
| Fluorescent inking layer thickness (μ) | 2.0 (25%)*1 | 2.0 (16.7%)*1 |
| Coloring inking layer thickness (μ) | 2.0 (7.5%)*2 | 4.0 (10.0%)*2 |

*1Ratio of the fluorescent substance to the total weight of the fluorescent and coloring inking layers
*2Ratio of the coloring agent to the total weight of the fluorescent and coloring inking layers

EXAMPLE 19

A fluorescent ink and a coloring ink were each prepared according to exactly the same procedure as Example 17 except that FA-41 Red Orange Color was used as the fluorescent substance. Then, both inks were admixed in the ratio of fluorescent ink/coloring ink = 1/1 (weight) to thereby make a mixed ink containing the fluorescent substance and the coloring agent in the same concentrations as in Example 17 (fluorescent substance: 25.0%, coloring agent: 7.5%). This ink was melted and applied on a 6 μ-thick polyester film so as to obtain a coated film thickness of 4.0μ. Thus, there was prepared a thermal transfer recording medium of single thermally meltable inking layer-type.

EXAMPLE 20

A thermal transfer recording medium of one thermally meltable inking layer-type was prepared according to exactly the same procedure as Example 19 except that a mixed ink having the following composition (the fluorescent substance was 50% and the coloring agent was 7.5% of the total of the fluorescent and coloring inking layers) as the mixed ink.

Mixed ink:
Red Orange Color FA-41: 50.0 parts
Lyonol Red CP-A: 5.0 parts
Seika Fast Yellow 2200M: 2.5 parts
Carnauba wax: 7.5 parts
Candelilla wax: 14.0 parts
Paraffin wax (melting point about 68.5° C.): 15.0 parts
Petroleum resin: 5.0 parts
Liquid paraffin: 1.0 part A commercially available transfer paper for use in PPC was placed on the surface of the inking layer of the aforesaid recording medium. A thermal head was put thereon from the recording medium side under the conditions: heat energy applied on the thermal head 0.50 mJ/dot (at 8 dots/mm head) and pushing pressure about 500 g/cm$^2$, and the portion of each inking layer corresponding to the thermal head was melted and transferred onto the transfer paper. Thereafter, the recording medium was directly peeled off at an acute angle relative to the surface of the transfer paper to thereby effect printing. The results obtained are shown in Table-10.

In addition, the above recording media and printings were subjected to fluorescence spectrum measurement. The obtained results were shown in Table-10.

TABLE 10

| | | | Example 17 | Example 18 | Example 19 | Example 20 |
|---|---|---|---|---|---|---|
| Fluorescence spectrum data | Printings | Fluorescent maximum wavelength | 606 nm | 606 nm | 603 nm | 603 nm |
| | | Fluorescent intensity (exciting wavelength) | 49.2 (468 nm) | 31.4 (468 nm) | 27.1 (468 nm) | 46.7 (468 nm) |
| | Sandwich structure | Fluorescent maximum wavelength | 606 nm | 606 nm | 603 nm | 603 nm |
| | | Fluorescent intensity on substrate side (exciting wavelength) | 28.6 (468 nm) | 26.3 (468 nm) | — | — |
| | | Fluorescent intensity on transfer paper (exciting wavelength) | 13.1 (468 nm) | 13.8 (468 nm) | — | — |
| Printing quality | Color density | | 1.51 | 1.59 | 1.49 | 1.62 |
| | Transferability | | good | good | somewhat inferior | bad |
| | Sharpness | | good | good | somewhat inferior | inferior |
| | Greasing | | none | none | none | none |

TABLE 10-continued

| | Example 17 | Example 18 | Example 19 | Example 20 |
|---|---|---|---|---|
| Fine line blur | none | none | observed | observed |

This table illustrates the same tendency as shown in Table-6. That is, although the recording media of Examples 17 and 18 and the recording media of Examples 19 and 20 have each used the same-concentrated fluorescent substance, the recording media of Examples 17 and 18 a high intensive fluorescence respectively as compared with the recording media of Examples 19 and 20. In order to obtain the fluorescence of the same intensity that the recording medium emits in one of the comparative examples, it is necessary that about 25% of the fluorescent substance should be contained in the inking layer as seen in Example 20. As a result, blur takes place especially in the printed fine line area.

EXAMPLE 21

A coloring ink system and a fluorescent ink system having the following compositions were prepared.

Coloring ink system:

Lake Red C #405 (produced by DAINICHI SEIKA KOGYO Co.): 6.3 parts

Seika Fast Yellow 2200M (produced by DAINICHI SEIKA KOGYO Co.): 0.7 part

Carnauba wax 14.2 parts

Paraffin wax (melting point about 68.5° C.): 28.5 parts

Petroleum resin: 5.0 parts

Mineral oil: 1.3 parts

Fluorescent ink system:

FZ-3041 Red Orange Color: 22.0 parts

Carnauba wax: 5.5 parts

Paraffin wax (melting point about 68.5° C.): 11.1 parts

Petroleum resin: 5.0 parts

Mineral oil: 0.4 part

Next, the coloring ink system and the fluorescent ink system were each melted and each component was uniformly dispersed. Thereafter, these systems as-melted were admixed. This mixture was hot-melt-coated on a 6 μ-thick polyester film so as to have the coated thickness of 5.5 μm to thereby form a thermally meltable inking layer.

EXAMPLE 22

A thermally meltable inking layer was formed according to exactly the same procedure as Example 21 except that a coloring ink system having the following composition was employed as the coloring ink system.

Coloring ink system

Ultra Rose F (produced by TOYO INK K.K.): 4.0 parts

Seika Fast Yellow 2200M (produced by DAINICHI SEIKA KOGYO Co.): 3.0 parts

Carnauba wax: 14.2 parts

Paraffin wax (melting point about 68.5° C.): 28.5 parts

Petroleum resin: 5.0 parts

Mineral oil: 1.3 parts

EXAMPLE 23

A thermally meltable inking layer was formed according to exactly the same procedure as Example 22 except that a coloring ink system having the under mentioned composition was employed as the coloring ink system.

Coloring ink system:

Lyonogen Violet RL (produced by TOYO INK K.K.): 7.0 parts

Carnauba wax: 14.2 parts

Paraffin wax (melting point about 68.5° C.): 28.5 parts

Petroleum resin: 5.0 parts

Mineral oil: 1.3 parts

Figure 9:
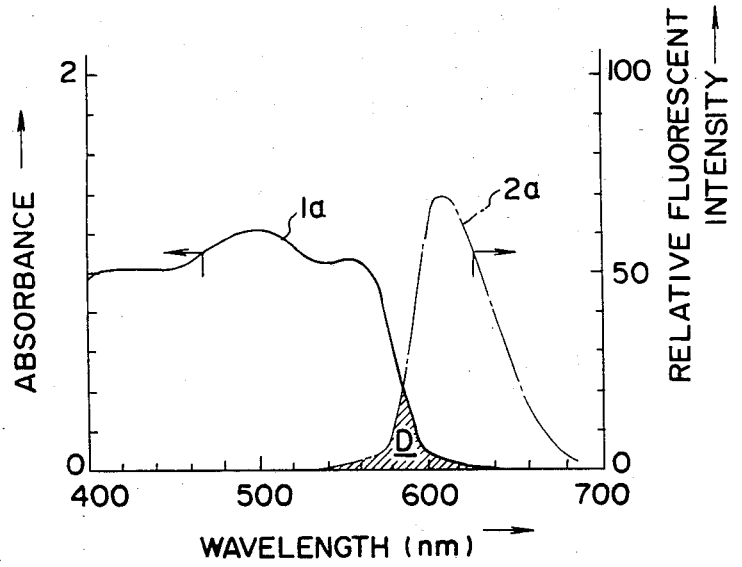
FIGS. 9 to 11 are graphs illustrating the relationship between the fluorescence spectrum and the absorption spectrum of the thermally meltable inking layer of the thermal transfer recording media prepared in each of Examples 21 to 23.
Figure 10:
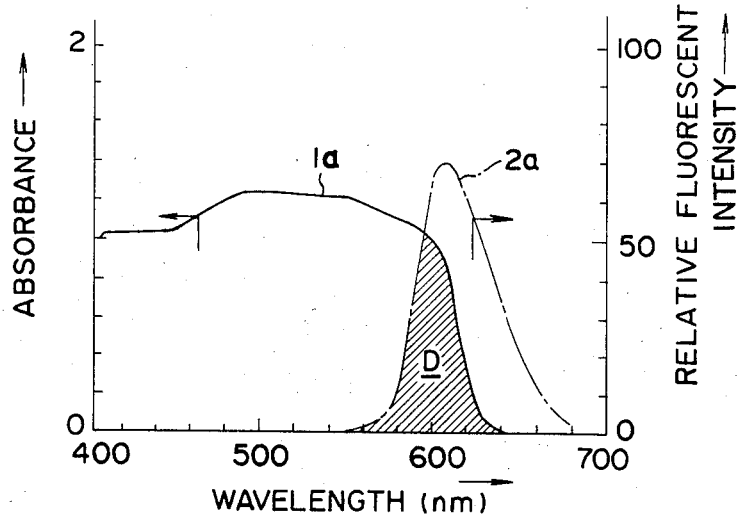
Figure 11:
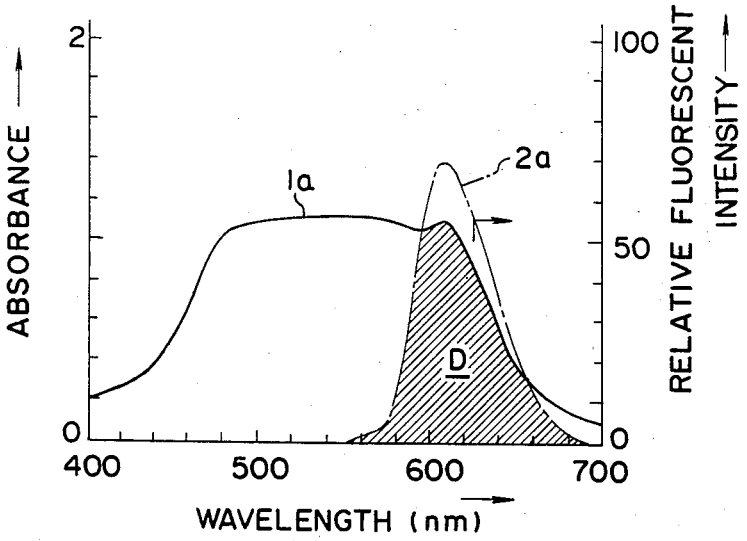

The fluorescence spectra (reflectance) 2*a* of the inking layers of the thus obtained thermal transfer recording media of Examples 21 to 22 and Example 23 are shown in FIGS. 9 to 11 respectively. The measuring conditions are as shown below.

Measuring apparatus: HITACHI 650-60 Fluorescence Spectrophotometer (scanning speed: 120 nm/min., slit: 1 nm on both exiciting and luminescent sides)

The absorption spectra (reflectance) 1*a* of the inking layers were also shown in the respective figures. In each figure, on oblique lined portion D is the overlap portion between the luminescence spectrum and the absorption spectrum, which indicates the amount of fluorescence of the fluorescent substance absorbed by the coloring agent.

Next, a commercially available recording paper [PPC Paper Type 1000 (PPC Copying Transfer Paper) produced by RICOH K.K.] was placed on the inking layer of each of these thermal transfer recording media. A thermal head was put thereon from the recording medium side under the conditions: heat energy applied on the thermal head 0.50 mJ/dot (at 8 dots/mm head) and pushing pressure about 500 g/cm$^2$, and the portion of the inking layer corresponding to the thermal head was melted and transferred onto the recording paper. Thereafter, the recording media was directly peeled off at an acute angle relative to the surface of the recording paper to thereby effect printing record. The results are shown in Table-11.

TABLE 11

| | | Example 21 | Example 22 | Example 23 |
|---|---|---|---|---|
| Thickness of inking layer (μm) | | 5.5 | 5.5 | 5.5 |
| Fluorescence performance | Fluorescent maximum wavelength (nm) | 603 | 603 | 603 |
| | Relative fluorescent intensity | 29.5 | 17.3 | 6.1 |
| Printing performance | Color density | 1.66 | 1.71 | 1.69 |
| | Transferability | good | good | good |
| | Fine line blur | none | none | none |
| | Greasing | none | none | none |

It is apparent from this table that both Examples 21 and 22 and Example 23 are surely superior in printing quality, but they are conspicuously different in fluorescence performance from each other, in other words Examples 21 and 22 exhibit marked effects in this respect. Consequently, it was confirmed that when exposed to a white light, both produce normal red images, but when exposed to a black light, Examples 21 and 22 emit a brighter red-orange light as compared with Example 23.

What is claimed is:

1. In a thermal transfer recording medium which comprises a heat-resistant substrate and a thermally meltable inking layer consisting essentially of a coloring agent, waxes and a binder on said substrate, the improvement which comprises; a fluorescent substance consisting of a wax-like substance solid solution or a resin solid solution of a fluorescent dye, said solid solution having a melting or softening point of 50°-140° C., is further contained in said inking layer.

2. A recording medium according to claim 1, wherein the content of fluorescent dyes in said wax-like substance solid solution or resin solid solution is 0.1-5.0 wt.%.

3. A recording medium according to claim 1, wherein the contents of the coloring agent, waxes, the binder and the fluorescent substance are 1-30%, 30-90%, 1-15% and 20-70% of the weight of the inking layer respectively.

4. A recording medium according to claim 1, wherein the concentration of the fluorescent substance is higher close to the substrate.

5. A recording medium according to claim 1 wherein the coloring agent has a fluorescence absorption of 40% or less.

6. A recording medium according to claim 1, wherein the coloring agent is one or more pigments.

7. A recording medium as claimed in claim 1, wherein said inking layer comprises, by weight, 1-30% coloring agent, 30-90% waxes, 1-15% binder and 7.5-70% fluorescent substance.

8. A thermal transfer recording medium as claimed in claim 1, wherein said coloring agent is selected from oil soluble dyes of the group consisting of Sumikaron Violet RS, Dianix Fast Violet 3R-FS, Kanaron Polyole Brilliant Blue-N-BGM, Kayaron Polyole Brilliant Blue-BM, Kayaron Polyole Dark Blue-2BM, Sumikaron Diazoblack 5G, Direct Dark Green B, Direct Brown M, Direct Fast Black D, Kayanol Milling Cyanine 5R, Sumikalyl Blue-6G, Aizen Malachite Green, Rhodamine B, Rhodamine 6G, Victoria Blue, and pigments selected from the group consisting of Victoria Blue lakes, metal-free phthalocyanine, phthalocyanine, Fast Sky Blue, Permanent Red 4R, Brilliant Fast Scarlet, Brilliant Carmine BS, Permanent Carmine FB, Lithole Red, Permanent Red F5R, Brilliant Carmine 6B, Pigment Scarlet 3B, Rhodamine Lake B, Rhodamine Lake T, Alizarin Lake, Fast Red, Bright Red G Toner, Lyonol Red CP-A, Chrome Yellow, Zinc Yellow zinc chromate, Lemon yellow (barium chromate), Cadmium yellow, Naphthol Yellow B, Hansa Yellow 5G, Hansa Yellow 3G, Hansa Yellow G, Hansa Yellow A, Hansa Yellow RN, Hansa Yellow R, Benzidine Yellow, Benzidine Yellow G, Benzidine Yellow GR, Permanent Yellow NCG, Quinoline Yellow Lake and Fast Yellow.

9. A thermal transfer recording medium comprising a heat-resistant substrate having a thickness of from 3 to 20 micrometers and coated with a thermal melting inking layer having a thickness of about 2 to 10 micrometers, said thermal melting inking layer consisting essentially of from 1 to 30% by weight of a coloring dye or pigment having a fluorescence absorption of 40% or less, from 30 to 90% by weight of waxy material, from 1 to 20% by weight of binder resin and from 7.5 to 70% by weight of a fluorescent substance having a melting point of from 50° to 140° C., said flourescent substance consisting essentially of a mixture of a flourescent organic dye dissolved in or deposited on a waxy material or a resin, said mixture containing from 0.1 to 5 wt. % of said fluorescent organic dye, based on the weight of said fluorescent substance.

10. A thermal transfer recording medium as claimed in claim 9 in which said fluorescent organic dye is dissolved in a waxy material selected from the group consisting of stearic acid monoethanolamide, lauric acid monoethanolamide, coconut oil fatty acid monoethanolamide, sorbitan behenic acid ester, sorbitan stearic acid ester, glycerine monostearic acid ester, acetyl sorbitol, benzoyl sorbitol and acetyl mannitol.

11. A thermal transfer recording medium as claimed in claim 9 in which said fluorescent organic dye is dissolved in or deposited on a resin selected from the group consisting of polycaprolactone, polyethylene glycol, melamine-toluenesulfonamide resin, benzyl sulfonamide resin, acrylic resin and linear polyamide resin.

12. A thermal transfer recording medium as claimed in claim 9 in which said waxy material is selected from the group consisting of higher fatty acid ethanolamides, higher fatty acid esters, acylated sorbitan and acrylated mannitol, and said resin is selected from the group consisting of polycaprolactone, polyethylene glycol, aromatic sulfonamide resin, acrylic resin, polyamide resin, polyvinyl chloride, vinyl chloride-vinyl acetate copolymer, alkyd resin, urea resin, melamine resin and benzoguanamine resin.

13. A thermal transfer recording medium comprising a heat-resistant substrate having a thickness of from 3 to 20 micrometers coated with a thermal melting inking layer having a thickness of about 2 to 10 micrometers, said thermal melting inking layer comprising from 1 to 30% by weight of a coloring dye or pigment having a fluorescence absorption of 40% or less, from 30 to 90% by weight of waxy material, from 1 to 20% by weight of binder resin and from 7.5 to 70% by weight of a fluorescent substance having a melting point of from 50° to 140° C., said fluorescent substance consisting essentially of a mixture of a fluorescent organic dye dissolved in or deposited on a waxy material or a resin, said mixture containing from 0.1 to 5 wt. % of said fluorescent organic dye, based on the weight of said fluorescent substance, said thermal melting inking layer consisting of a first sub-layer which is substantially free of said coloring dye or pigment, which contains said flourescent substance and is located adjacent to said substrate, and a second sublayer which contains said coloring dye or pigment, which is substantially free of said fluorescent substance and is located remote from said substrate.

14. A thermal transfer recording medium as claimed in claim 13 in which said fluorescent organic dye is dissolved in a waxy material selected from the group consisting of stearic acid monoethanolamide, lauric acid monoethanolamide, coconut oil fatty acid monoethanolamide, sorbitan behenic acid ester, sorbitan stearic acid ester, glycerine monostearic acid ester, acetyl sorbitol, benzoyl sorbitol and acetyl mannitol.

15. A thermal transfer recording medium as claimed in claim 13 in which said fluorescent organic dye is dissolved in a resin selected from the group consisting of polycaprolactone, polyethylene glycol, melamine-toluenesulfonamide resin, benzyl sulfonamide resin, acrylic resin and linear polyamide resin.

16. A thermal transfer recording medium as claimed in claim 13 in which said waxy material is selected from the group consisting of higher fatty acid ethanolamides, higher fatty acid esters, acrylated sorbitan and acylated mannitol, and said resin is selected from the group consisting of polycaprolactone, polyethylene glycol, aromatic sulfonamide resin, acrylic resin, polyamide resin, polyvinyl chloride, vinyl chloride-vinyl acetate copolymer, alkyd resin, urea resin, melamine resin and benzoguanamine resin.

* * * * *